United States Patent [19]

Townsend

[11] Patent Number: 5,028,301

[45] Date of Patent: Jul. 2, 1991

[54] SUPERSATURATION PLATING OF ALUMINUM WETTABLE CATHODE COATINGS DURING ALUMINUM SMELTING IN DRAINED CATHODE CELLS

[76] Inventor: Douglas W. Townsend, 492 Longtowne Ct., Glen Burnie, Md. 21061

[21] Appl. No.: 294,781

[22] Filed: Jan. 9, 1989

[51] Int. Cl.[5] ..... C25D 3/66; C25C 3/06; B05D 5/12

[52] U.S. Cl. ..... 204/39; 204/67; 204/245.5; 204/294; 427/77; 427/126.1; 427/431; 427/443.2; 427/123

[58] Field of Search ..... 204/67, 243 R–247, 204/294, 39; 427/123, 126.1, 77, 431, 443.2; 420/552

[56] References Cited

U.S. PATENT DOCUMENTS

| | | | |
|---|---|---|---|
| 400,766 | 4/1889 | Hall | 204/243 R |
| 3,028,324 | 4/1962 | Ransley | 204/67 |
| 3,067,124 | 12/1967 | de Pava | 204/244 |
| 3,,400,061 | 9/1968 | Lewis et al. | 204/67 |
| 3,471,380 | 10/1969 | Bullough | 204/67 |
| 3,785,807 | 1/1974 | Backerud | 420/552 |
| 3,961,995 | 6/1976 | Alliot et al. | 420/552 X |
| 4,093,524 | 6/1978 | Payne | 204/67 X |
| 4,333,813 | 6/1982 | Kaplan et al. | 204/243 R |
| 4,341,611 | 7/1982 | Kaplan | 204/243 R |
| 4,383,970 | 5/1983 | Komuro et al. | 420/552 X |
| 4,466,692 | 8/1984 | Sonoda | 439/730 |
| 4,466,995 | 8/1984 | Boxall | 204/290 R X |
| 4,466,996 | 8/1984 | Boxall | 204/67 X |
| 4,526,911 | 7/1985 | Boxall | 523/445 |
| 4,544,469 | 10/1985 | Boxall | 204/243 R |
| 4,560,448 | 12/1985 | Sane | 204/67 |
| 4,624,705 | 11/1986 | Jatkar et al. | 420/552 X |
| 4,624,766 | 11/1986 | Boxall | 204/294 |

FOREIGN PATENT DOCUMENTS

| | | | |
|---|---|---|---|
| 0021850 | 1/1980 | European Pat. Off. . | |
| 1268812 | 3/1972 | United Kingdom | 420/552 |

OTHER PUBLICATIONS

P. 35, American Society for Metals, 1969, Abstract 23–0148, Freeing Aluminum from Vanadium and Titanium . . . , Senin et al.

*Primary Examiner*—Donald R. Valentine

[57] ABSTRACT

This invention relates to a process for electrowinning molten aluminum from alumina dissolved in molten fluoride salts which are essentially cryolite. More specifically the process relates to the treatment of aluminum reduction cell drained solid cathode surfaces to make them wetted by molten aluminum metal. This process deposits a coating composed of titanium diboride and titanium carbide on the solid cathode surfaces from supersaturated dissolved elements in electrowon aluminum. The electrowon aluminum wets the coating on the cathode. The coating makes the cathode surfaces resistant to erosion, chemical attack and penetration by the molten aluminum metal, sodium and cryolite electrolyte contained in that cell.

36 Claims, 4 Drawing Sheets

SUPERSATURATION PLATING OF ALUMINUM WETTABLE CATHODE COATINGS DURING ALUMINUM SMELTING IN DRAINED CATHODE CELLS

CROSS REFERENCE TO A RELATED APPLICATION

Applicant has filed Disclosure Document 231,083 on Oct. 26, 1988 and this Disclosure Document is incorporated herein.

BACKGROUND OF THE INVENTION

The field of the invention is chemical and electrical processes for synthesizing metal from a fused bath and the present process is particularly concerned with electrowinning aluminum from a fused bath of cryolite and aluminum compounds.

The state of the art of the electrowinning process begins with U.S. Pat. No. 400,766 and the state of the art of the aluminum reduction cell useful in the present invention may be understood by reference to U.S. Pat. No. 3,400,061 and 4,093,524, the disclosures of which are incorporated herein by reference. Also incorporated by reference herein are U.S. Pat. Nos. 3,028,324; 3,067,124; 3,471,380; 4,333,813; 4,341,611; 4,466,995; 4,466,996; 4,526,911; 4,544,469; 4,560,448; 4,624,766 and European Patent Application 0 021 850 which show the state of the art of protecting cathodes from erosion during the electrowinning of aluminum U.S. Pat. Nos. 3,028,324, 3,471,380 and 4,560,448 disclose particular solutions of titanium in molten aluminum.

Most aluminum metal is smelted by being electrowon from alumina, $Al_2O_3$ dissolved in a molten salt electrolyte which is mostly cryolite, $Na_3AlF_6$ by a process little changed from that described by Hall (U.S. Pat. No. 400,766, 1889). The cryolite electrolyte usually also contains several percentage of each of aluminum fluoride, $AlF_3$ and calcium fluoride, $CaF_2$. The cryolite electrolyte may also contain several percentage of both magnesium fluoride, $MgF_2$, and lithium fluoride, LiF. The electrolyte fills most of the bottom part of the cavity of the cell including the vertical gap between the cathode and anodes. The electrowinning smelting process is carried out at temperatures that may be as low as 920° C. and or as high as 1000° C. The usual operating temperature range is from 950° C. to 975° C. Conventional aluminum smelting cells are well described in THE ENCYCLOPEDIA OF ELECTROCHEMISTRY, Reinhold Publishing Corporation, New York, 1964. These conventional cells are constructed with carbon anodes and in modern cells carbon block cathodes, called in the industry "cathode blocks". The carbon blocks hold a cathode pool, often called the cathode pad in the industry, containing up to 12 tons of molten aluminum metal that serves electrochemically as the actual cathode. The whole structure, including the carbon cathode blocks, steel electrical current conductors, insulation and steel pot shell is known in the industry as the "cathode". The anode is geometrically above the cathode by virtue of the fact that cryolite is slightly lighter than aluminum. It floats on top of the molten aluminum metal and washes around the carbon anodes. The anodes are chemically attacked in the electrowinning smelting process and must be replaced about every two weeks. Cathodes must last the expected 3 to 5 years life of the cell.

The pool of molten aluminum is called the cathode or metal pad. In conventional aluminum reduction cells the metal cathode pool ranges in depth from 5 to 30 centimeters to produce enough hydrostatic pressure to force the molten metal pool into electrical contact with the surface of the carbon cathode blocks. This is necessary because molten aluminum poorly wets the surface of the carbon cathode substrate. Electrical contacts are made with areas of the carbon surface that are momentarily free of electrically insulating materials. At any given moment there are only relatively small areas with good electrical contact between the aluminum pool and the cathode blocks. The remainder of the interface is insulated by a thin layer of molten cryolite, deposits of undissolved alumina ore and by aluminum carbide, which is a poor electrical conductor. Aluminum carbide readily forms by chemical reaction between molten aluminum metal and carbon of the cathode blocks wherever the two are in contact. Aluminum carbide is somewhat soluble in cryolite electrolyte. It is dissolved away by a layer of cryolite electrolyte, that is normally found between most areas of the metal pool and the carbon cathode despite the hydrostatic pressure exerted by the pool of molten aluminum. Cryolite, not aluminum, prefers to wet carbon and aluminum carbide surfaces. All areas of the cathode block carbon surfaces are periodically eaten away by the process of reacting with aluminum metal to form aluminum carbide which is dissolved away by a layer of molten cryolite. Cryolite is continuously dragged between the aluminum pool and the carbon cathode by motion of the aluminum pool. Wherever aluminum carbide is dissolved away, the carbon cathode blocks may again come into electrical contact with molten metal and for a brief time conduct electricity away from the metal pool. The carbon surface of the cathode is thus steadily eroded away at rates that are typically 3 to 5 centimeters per year.

The top surface of the molten aluminum metal cathode pool is covered by standing and moving waves The tops of the metal waves tend to short circuit the aluminum electrowinning process by making electrical short circuit paths between the anodes and the cathode. Such shorting results in losses of 6% to 20% in current efficiency in the smelting industry. Most existing smelters have current efficiencies that range from 78% to 90% out of the possible 98% that can theoretically be obtained. The current efficiency is measured by the total amount of metal actually collected from the cell divided by the amount that could have been collected if one aluminum atom were produced for every three electrons that flow through the cell.

Electrical short circuiting in aluminum reduction cells with metal cathode pools is reduced by increasing the vertical distance between the anode and the cathode to about 5 centimeters. Cryolite based electrolyte in the gap between the cathode and anodes has an electrical resistivity of about 0.42 ohm-cm and carries a direct electrical current of between 0.7 and 1.5 Amperes/$cm^2$. The electrical current flowing through the cryolite electrolyte in the gap between the anode and the cathode generates electrical heat, and wastes large amounts of electrical power. Reduction of the vertical gap between the cathodes and anodes to 1 to 2 centimeters can save from 2 to 4 kilo Watt hours per kilogram, of aluminum electrowon. This is up to 25%; of the power normally required to smelt aluminum. An additional benefit from a drained cathode cell is an increase in cell current efficiency of from 5% to 20%.

The height of the waves on the aluminum pool has been reduced in some of the more recently constructed smelters by computer aided design of the array of electrical conductors that together generate complex patterns of magnetic vectors in the aluminum pool. These magnetic vectors interact with the electrical current flowing in the aluminum pool to cause high metal velocities in the aluminum pool and to generate waves on its surface. Some waves run from side to side, others from end to end while others rotate around the perimeter of the pot. It is most difficult and expensive to reduce the intensities of the various components of the magnetic field in existing smelters to reduce metal motion.

One possible way to prevent the molten aluminum from forming waves is to remove the metal pool from the cathode surface and to smelt aluminum on a raised solid cathode surface. An example of this design of aluminum smelting cell is illustrated by Lewis et al (U.S. Pat. No. 3,400,061). The raised cathode surface must be covered by a coating that is wetted by the molten aluminum. The coating must not be significantly attacked by either the molten cryolite or molten aluminum during operation of the cell. The coating must last from three to five years to give the cell an economically long life.

The desire to reduce the electrical power consumption in the smelting of aluminum has resulted in many conceptual designs for aluminum reduction cells and the construction of a few prototype production cells having solid cathode surfaces drained of aluminum metal. For such a cell to smelt alumina efficiently, aluminum metal must easily wet raised solid cathode surfaces so that the electrowon aluminum metal sticks to the cathode surface and drains off into collection wells away from the areas of electrolysis without being carried off into the cryolite electrolyte as tiny droplets.

Titanium diboride has been identified as a material ideally suited to form the solid cathode surface, Ransley (U.S. Pat. No. 3,028,324, 1962). Whenever titanium diboride is mentioned in this application it must be understood that the borides of Groups IV-B, V-B and VI-B of the periodic table which include the elements; titanium, zirconium, hafnium, chromium, vanadium, niobium, tantalum, chromium, molybdenum, and tungsten and mixtures thereof may be substituted for titanium diboride. Titanium diboride and similar diborides are wetted by aluminum metal, are excellent electrical and thermal conductors and are sparingly soluble in both molten aluminum metal and cryolite based electrolytes.

Some prior U.S. patents have attempted to provide this aluminum wetted surface by covering the structural carbon blocks of the cathode with tiles made from titanium and zirconium diborides; Lewis et al (U.S. Pat. No. 3,400,061), Payne (U.S Pat. No. 4,093,524) and Kaplan U.S. Pat. No. 4,333,813 and U.S. Pat. No. 4,341,611). Many attempts have been made to coat carbon cathode surfaces of drained cathode aluminum reduction cells with smeared coatings composed of titanium diboride mixed with carbon cement; Boxall et al (U.S. Pat. Nos. 4,544,469; 4,466,692; 4,466,995; 4,466,996; 4,526,911; 4,544,469 and 4,624,766). Attempts have also been made to form titanium diboride coatings on the surface of the carbon cathode substrate by electroplating prior to producing aluminum metal; Biddulph (European Patent Application 0 021 850).

The various arts found in all previous patents have not yet been successful in providing a durable aluminum wetted cathode surface that is resistant to both molten aluminum metal and cryolite electrolyte. Each art suffers from at least one of the following failure mechanisms: the coating material is attacked by aluminum metal or cryolite electrolyte; preformed structural shapes are cracked and broken by rough handling or by stresses caused by uneven thermal expansion during cell start-up; a difference in the coefficient of thermal expansion between the coating and carbon cathode substrate combined with attaching the coating material at room temperature by a glue that becomes brittle at a temperature well below the cell operating temperature results in shear stresses that cause the tiles to disbond; or the glue is chemically attacked or dissolved by aluminum metal and/or cryolite electrolyte.

Most patented cathode coating systems for aluminum smelting are based on preformed structures containing titanium diboride and glue systems to fasten the preformed structures to the carbon cathode substrate. Preferred structures may be pure titanium diboride or mixtures of titanium diboride and bonding materials such as carbon and aluminum nitride. Glues are usually various formulations of carbon cement. The glue joint is subject to fracture while heating up of the cell to the 970° C. operating temperature due to the large difference between the coefficients of thermal expansion between titanium diboride and amorphous and graphitic forms of carbon cathode blocks used to construct aluminum smelting cells. These cells can be heated only by slow and careful procedures that properly dry, cure and carbonize the carbon cement and to prevent $TiB_2$ structures from being mechanically damaged by cracking or spalling by differential thermal expansion. In addition, large shear stresses may develop between titanium diboride preformed structures and the carbon cathode structure because carbon has a lower coefficient of thermal expansion than has titanium diboride. Shear stresses can cause the glue joint to fail and titanium diboride structures to disbond from the cathode blocks, even before the cell starts to operate.

Special care is required to prevent air burn of the carbon cement and to the titanium diboride during the heating step. Typical means of heating cells for start up are to use oil or gas burners to preheat the cathode surface over a period of 8 to 24 hours to a temperature of about 800° C., while the cathode surface is protected by an inert or chemically reducing material such as a layer of crushed frozen cryolite electrolyte or coke to exclude air. Alternately, the cell can be protected while being heated by the electrical resistance of a layer of coke placed between the anode and the cathode while direct electrical line current is passed between the cathode and anodes to slowly heat the cell over a period of a day or two. When the cell reaches a temperature of about 800° C., molten cryolite may be pored into the cell and the process of electrowinning aluminum started. The electrical resistance heating associated with electrowinning aluminum is used to further heat the cell to the equilibrium operating balance between electrical heat generated and process heat used and thermal losses.

Any glue joint holding titanium diboride structure to the carbon cathode substrate that survives cell start up is usually rapidly attacked during cell operation by aluminum and cryolite, just as the carbon cathode surface of a conventional aluminum smelting cell is attacked. Aluminum metal also tries to wet the back side of titanium diboride structures against the glue joint while cryolite tries to wet the carbon side of the glue joint and dissolve any aluminum carbide formed from the carbon cement by the penetrating aluminum metal. Carbon cements react more readily with aluminum to form aluminum carbide than do cathode carbon blocks that are baked at a much higher temperature.

The carbon blocks of the cathode substrate undergo from 0.2% to 2% swelling in volume during the first 60 days of cell operation as electroreduced sodium and lithium metals intercalate into the carbon matrix. Any cathode coating system must either swell at the same rate as the carbon blocks or else be able to withstand stresses caused by the expansion.

Structural shapes containing titanium diboride and sintered at temperatures above about 1500° C. are very hard and brittle. Titanium diboride structures that have been sintered above 1500° C. are generally too brittle to withstand the stresses incurred and suffer breakage and disbondment from the cathode substrate during glue sintering, cell start up and normal operation. These structures are also extremely expensive to fabricate and install in the cell.

Another approach to making an aluminum wetted cathode surface is to mix either coarse chunks or finely divided titanium diboride with carbon cement or pitch to form a carbon matrix containing dispersed titanium diboride particles. This wet mixture may be spread onto the cathode surface when building the cell and baked by warming the cell cathode. Alternately this material may be baked into structural shapes at temperatures below 1500° C. and then glued to the carbon cathode substrate. This material is softer but tougher than titanium diboride preformed structures and generally adheres to the cathode blocks during cell start up but fails rapidly during cell use because molten aluminum penetrates the coating and chemically reacts with the carbon matrix to form aluminum carbide. Aluminum carbide forms first on the top surface and along cracks in the coating. Considerable mechanical expansion occurs during the formation of aluminum carbide since aluminum carbide occupies about four times the volume of the carbon required to form it. As aluminum carbide forms along cracks and as aluminum carbide is dissolved by the cryolite the coating rapidly disintegrates. Titanium diboride-carbon cathode surface coatings have little resistance to erosion by molten cryolite based electrolytes. Coatings are rapidly attacked by carbon dioxide bubbles that may be periodically swept against its surface. The coatings may fail mechanically by a freeze-thaw mechanism when cryolite freezes on the cathode surface as cold anodes are introduced into the cell every couple of weeks. Both carbon dioxide attack and freeze-thaw damage is more likely when an anode is inadvertently set lower into the cathode cavity than was intended.

No smeared coating or attached preformed structure can be repaired or replaced without shutting the cell down. Any cathode surface coating must be able to withstand mechanical abuse that is normal to cell operation. This includes being poked by steel bars and other tools used to work the cell and make measurements, anodes dropping on the cathode surface, alumina ore deposits that may from time to time fall onto and even freeze to the surface, cryolite electrolyte freezing, occasional burning by carbon dioxide bubbles, electric arcing caused by short circuiting, as well as areas eroded by strong turbulence in the cryolite electrolyte. After about 15% of the drained cathode surface area has lost its aluminum wetted coating, the cell looses so much current efficiency that it is no longer economical to operate.

SUMMARY OF THE INVENTION

The present invention relates to novel processed for coating a carbon cathode substrate to make molten aluminum metal wet and spread over its surface in a thin laminar film, believed to be about 0.012 centimeters thick.

This invention comprises the introduction of small concentrations of oxides and/or salts of titanium and boron into the cryolite electrolyte to codeposit titanium and boron into a laminar film of aluminum metal on solid cathode surfaces or to react with the carbon cathode substrate and form deposits on that carbon cathode substrate that are wetted by aluminum metal and protect the cathode carbon substrate from being attacked. It is preferable to maintain a relatively small supersaturation of titanium and boron in the laminar film of molten aluminum metal to improve the morphology of the coating deposits. These deposits may be made more favorably smoother and denser when a relatively low supersaturation of titanium and boron is codeposited than when larger supersaturations are codeposited in the laminar film of aluminum metal. This is achieved by choosing boron and titanium supersaturations in the electrodeposited aluminum that produce a minimum titanium diboride plating rate of 0.01 centimeters per year.

The molten aluminum wets the solid coating, grown on the carbon cathode substrate from electrowon aluminum, supersaturated with codeposited trace concentrations of titanium or related metals of Groups IV-B, V-B and VI-B of the periodic table of elements and boron. This physical process is previously unknown and is hereby designated "supersaturation plating". The novel plating process is possible only because the molten aluminum metal in any desired degree of supersaturation with the sparingly soluble titanium and boron can be continuously electrodeposited at a constant temperature onto the top surface of the thin laminar film of molten aluminum metal draining off the cathode surface. Because the thin laminar film of molten aluminum metal is relatively free of suspended tramp nuclei onto which diborides can grow and is intentionally kept at a supersaturation level below the concentration where spontaneous nucleation of titanium diboride particles is probable and because the laminar film of molten aluminum is relatively thin and is therefore free from convective and electromagnetic mixing, titanium diboride deposits can be continuously grown as a uniform smooth coating on the cathode substrate. The process is somewhat similar to vapor plating but the rate of growth of the coating is relatively slower because of the necessity of titanium and boron atoms having to diffuse through the molten laminar film of aluminum metal and to compete with adsorbed aluminum metal atoms for growth sites on the surface of the titanium diboride coating.

BRIEF DESCRIPTION OF THE DRAWINGS

Reference is made to the appended drawings that illustrate the chemistry of aluminum, carbon, boron and titanium and a possible design of an aluminum reduction cell employing the novel titanium diboride coating process of the present invention. The cell employs sloped solid carbon cathode block cathode substrates having an aluminum cathode surface that wets a titanium diboride coating on a carbon substrate formed from a laminar film of molten aluminum that is continuously electrodeposited onto the cathode surface and with codeposited trace concentrations of titanium and boron, in accordance with the invention.

DESCRIPTION OF THE PREFERRED EMBODIMENTS

Figure 1:
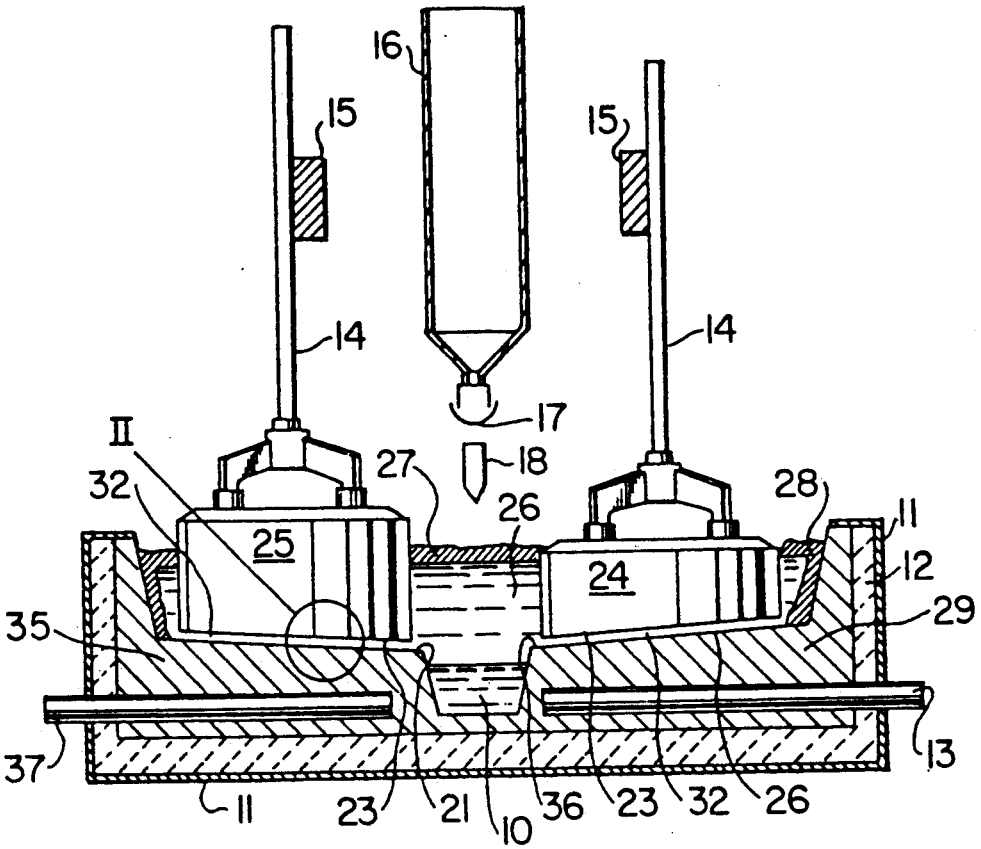
FIG. 1 is a vertical section through an aluminum reduction cell.

With particular reference to FIG. 1, the reduction cell comprises a steel shell 11 having a layer of suitable refractory insulation 12 and a cathode substrate comprising prebaked carbonaceous blocks 29 and 35. Steel cathode electrical current collector bars are illustrated at 13 and 37 set into the carbon cathode blocks 29 and 35. Carbonaceous prebaked anodes 24 and 25 are hung into the cell cavity from electrically conductive anode hanger rods 14, which are in electrical contact with anode electrical bus bars 15 from which they are supported. The cell is filled with molten cryolite electrolyte 26 and 32 except for accumulated electrowon aluminum metal 10 held in a cell formed between the cathode blocks 29 and 35, a layer of frozen cryolite 27 over the top of the molten cryolite 26 and frozen cryolite layer 28 covering the perimeter of the carbon cell cavity above the level of the cathode surfaces 21 and 36. The bottom surfaces of the carbon anodes 24 and 25 are shaped to correspond to the top surfaces of the cathodes 21 and 36.

Figure 2:
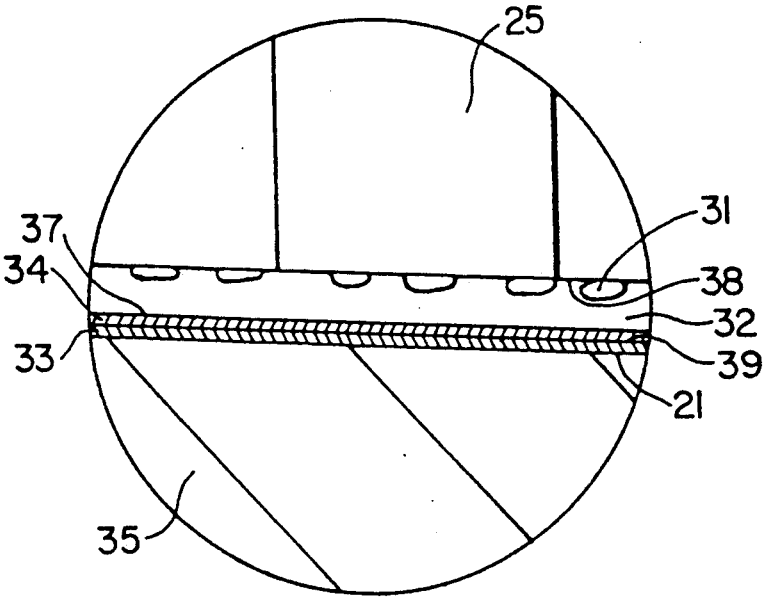
FIG. 2 is a detailed vertical section through a portion of FIG. 1 circled at 2.

FIG. 2 shows the thin laminar film of molten aluminum, the titanium diboride layer and the carbon cathode substrate in greater detail. The top surface 21 of the sloped cathode carbon substrate 35 is covered by a layer of solid titanium diboride coating 33, formed from trace concentrations of titanium and boron, deposited by the process of supersaturation plating from a laminar film of molten aluminum 34, that wets the surface 39 of the titanium diboride coating 33. Within the vertical distance from the top surface of the laminar film of molten aluminum metal 37 on the cathode to the bottom surface 38 of the anode 25 is a layer of cryolite electrolyte 32 which is urged up the slope by a gas lift pumping action caused by the buoyancy of the carbon dioxide bubbles 31 created by electrolysis of the carbon anode 25.

Figure 3:
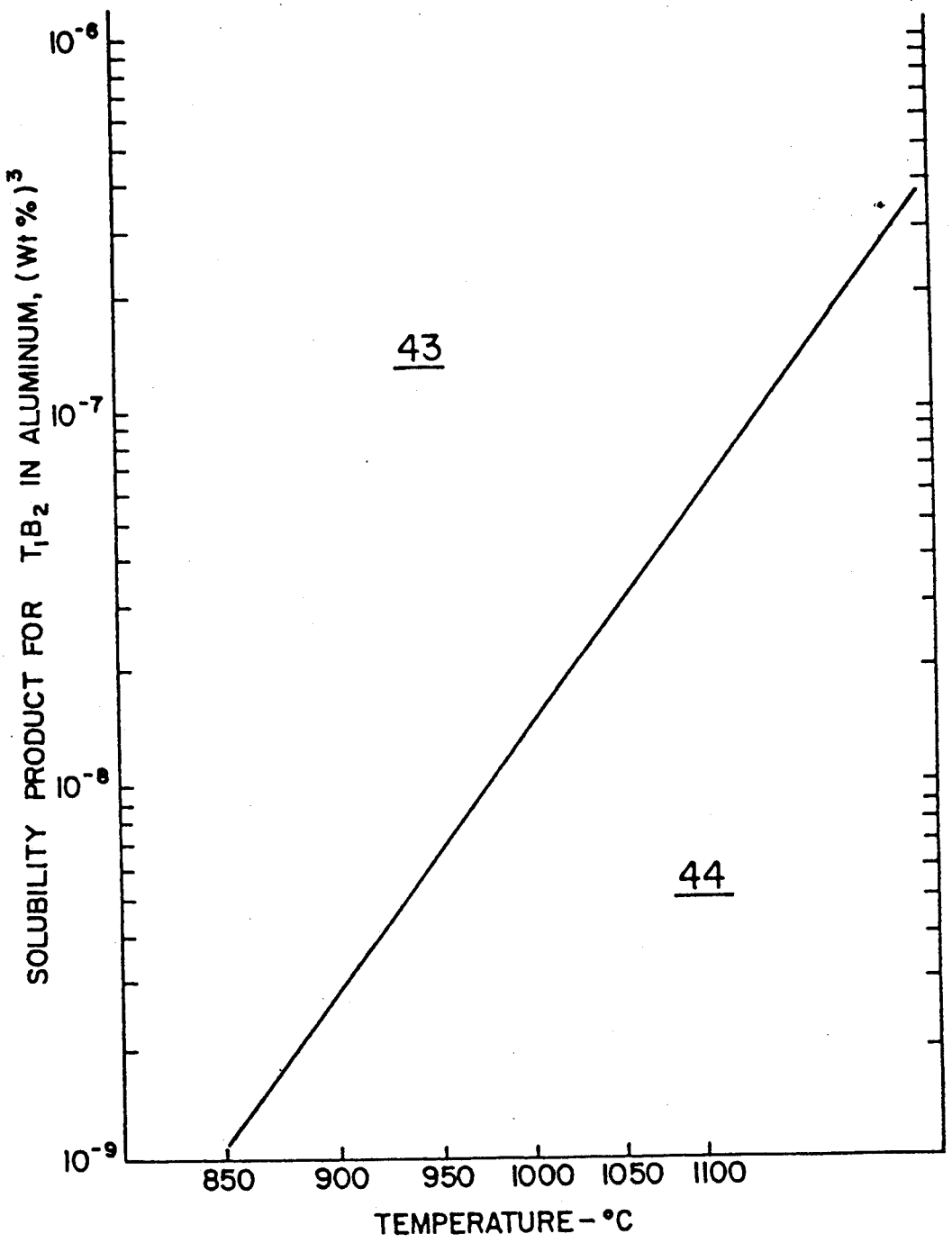
FIG. 3 shows the solubility product of titanium diboride expressed as weight percent titanium times the square of the weight percent boron dissolved in molten aluminum as a function of temperature.

FIG. 3 shows the solubility product of titanium diboride in aluminum metal as a function of temperature as a semilogarithmic plot. Above the sloping line in FIG. 3, area 43, aluminum is supersaturated with titanium and boron and below the sloping line in area 44, aluminum is unsaturated with titanium and boron. Titanium diboride, placed into molten aluminum that is not saturated with respect to titanium diboride will dissolve to the concentration required to satisfy the solubility product.

Figure 4:
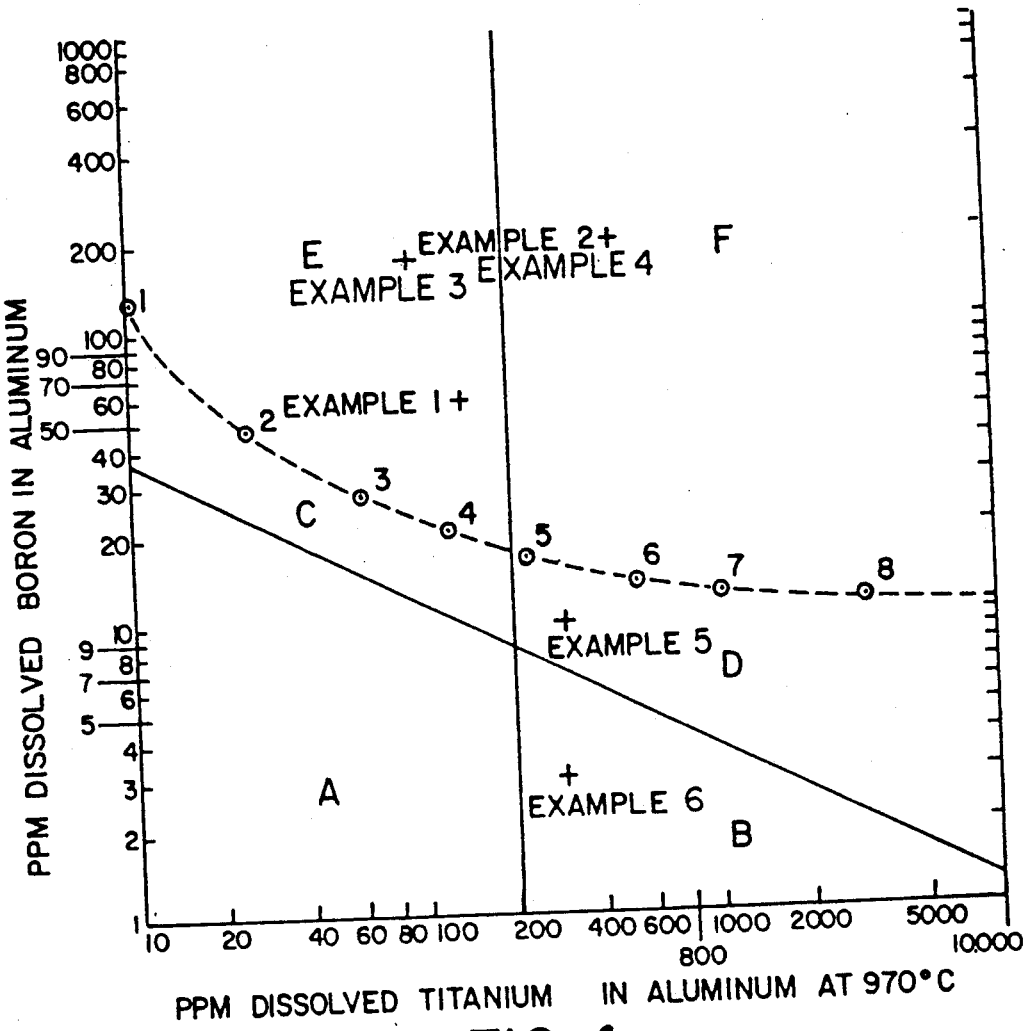
FIG. 4 shows the solubility of titanium diboride in molten aluminum at 970° C. as well as the reactions of titanium with carbon and aluminum carbide.

FIG. 4 shows the logarithmic solubility diagram for titanium, boron and carbon dissolved in molten aluminum at 970° C. as a function of the concentrations of dissolved boron and titanium over a range from 10 to 1000 parts per million boron and from 10 to 5000 parts per million titanium. The vertical line dividing zones A from B, zones C from D and zones E from F is drawn at about the stoichiometric solubility product for titanium carbide. The exact division between these zones varies with the carbon concentration in the molten aluminum. The stoichiometric titanium carbide solubility is thought to be 200 parts per million titanium and 50 parts per million carbon. This is somewhat lower than the carbon concentration in stoichiometric equilibrium with aluminum carbide. In zone A, at less than about 200 parts per million titanium and below the solubility product line for titanium diboride, both titanium diboride and titanium carbide dissolve in molten aluminum and aluminum carbide deposits freely form. In zone B, at more than about 200 parts per million titanium and below the solubility product line for titanium diboride, titanium diboride dissolves in molten aluminum while dissolved titanium chemically reacts with both carbon and aluminum carbide to form solid deposits of titanium carbide. In zone C, at less than about 200 parts per million dissolved titanium and above the solubility product line for titanium diboride and below the dashed line, exposed carbon may react with aluminum to form disrupting aluminum carbide deposits and titanium diboride may be deposited on the drained cathode surface by the process of supersaturation plating, at a rate less than 0.01 centimeters per year. The dashed line is drawn for a cathode current density of 1.0 amperes per square centimeter. This titanium diboride deposition rate is too slow to produce a continuous titanium diboride coating. In zone D, above about 200 part per million dissolved titanium and above the solubility product line for titanium diboride but below the dashed line, titanium diboride deposits may be formed on the cathode surface by the process of supersaturation plating, but at a rate less than 0.01 centimeters per year. In zone D titanium chemically reacts with exposed carbon and aluminum carbide to produce titanium carbide that may be mixed with titanium diboride deposits on the carbon cathode substrate. In zone E, at less than about 200 parts per million dissolved titanium and above both the solubility product line for titanium diboride and the dashed line, a titanium diboride coating may be deposited on the drained cathode surface by the process of supersaturation plating, at a rate greater than 0.01 centimeters per year. Exposed carbon may react with aluminum to form disruptive aluminum carbide deposits. In zone F, above about 200 part per million dissolved titanium and above both the solubility product line for titanium diboride and the dashed line, titanium diboride deposits may be formed on the cathode surface by the process of supersaturation plating, but at a rate greater than 0.01 centimeters per year, while titanium chemically reacts with exposed carbon and aluminum carbide to produce a titanium carbide coating that may be mixed with titanium diboride deposits on the carbon cathode substrate.

Figure 5:
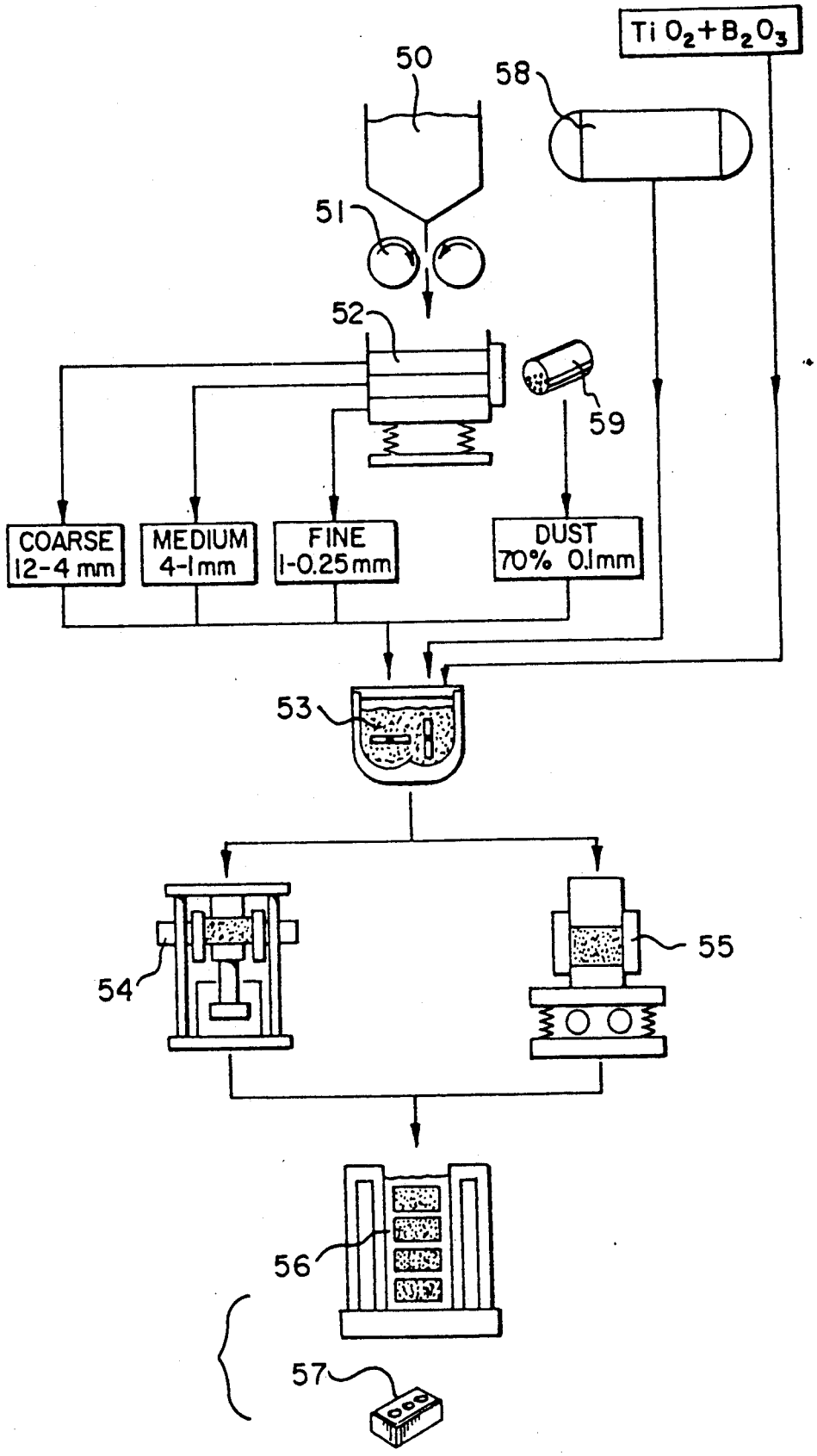
FIG. 5 is an anode production flow sheet showing the production of an anode useful in the present invention.

The titanium and boron used to form a supersaturated solution with molten aluminum may be supplied by the anode having $TiO_2$ and $B_2O_3$ incorporated therein and prepared according to the flow sheet of FIG. 5. A prebaked anode useful in the present invention and produced by the process of the flow sheet will have 0.005% to 13% by weight $TiO_2$ and 0.003% to 6% by weight $B_2O_3$. The remainder of t:e anode is carbon with some residual impurities such as sulfur vanadium, iron, nickel, silicon and sodium. Metal ani ortho boric acids fed to the green anode mix will decompose to $B_2O_3$ during calcining of the anode.

FIG. 5 shows a schematic anode production flow diagram wherein titanium and boron oxides are mixed with pitch and coke and are baked into anode blocks. Fresh coke and anode butts 50 are crushed to below 12 millimeters in size in the crusher 51 and separated into several size fractions by the screen 52. Coke size fractions are blended with coke dust from the ball mill 59, pitch 58 and $TiO_2+B_2O_3$ in the mixer 53. Anode blocks 57 are formed in either the anode hydraulic press 54 or vibrating press 55 and then baked in the furnace 57.

In improved drained cathode aluminum reduction cells, the bottom surfaces of the anodes 24 and 25 remain nearly parallel to the top surface of the cathodes 29 and 35. Both cathodes and anodes are typically sloped from the horizontal by between 2 and 15 degrees and preferably between 5 and 10 degrees to make the laminar film of electrowon aluminum metal, 34 run down the sloped surface of the cathode and to make the carbon dioxide bubbles 31 produced by the electrolysis of the anodes 24 and 25 flow upwards against the bottom surface of the anodes and to pump the molten cryolite electrolyte 32 up slope within the vertical gap between the cathodes and anodes. The molten cryolite electrolyte 32 rises up the sloped space between the cathodes and anodes because of both gas lift pumping and a buoyancy effect caused by reduced density due to electrically heating the cryolite 32. Cell heating to balance heat lost from the cell and to provide process heat is generated by electrical current flowing through the carbon and metal parts of the cell and through the molten eIectrolyte and from electrochemical polarizations on the electrode surfaces. Circulation of the molten cryolite electrolyte brings freshly dissolved alumina ore, $Al_2O_3$, into contact with the anodes and cathodes. Alumina ore is periodically introduced into the cryolite electrolyte 26 by opening the valve 17 on the storage bin 16 and by breaking the frozen cryolite crust 27 with the crust breaker oar 18. Alumina is required to supply aluminum ions to the call that can be electrowon to become aluminum metal and to supply oxygen ions to the cryolite, required to sustain the desired anode reaction that produces carbon dioxide gas and to avoid the undesirable, so called anode effect.

The electrowon molten aluminum continuously drains into wells 10 which are built into the cathode cavity, adjacent to the drained cathode surfaces 12 and 26. About one half of the concentration of superstaturated titanium and boron electrodeposited into the laminar film of molten aluminum 34 on the cathode surface plates onto the titanium diboride coating 33 on the cathode surface and the remainder deposits in the metal wells. Because the surface area of the metal wells is by necessity only about one quarter of that of the cathode surface, the rate of growth of titanium diboride in the metal wells is about four times as fast as on the cathode surface. To avoid excessive loss of metal reservoir capacity in the metal wells which would increase the frequency that aluminum metal must be tapped from the cell, the thickness of the titanium diboride deposits that can be grown on the cathode surface over the useful life of the cell is limited to about one centimeter.

The vertical gap between the anodes and the cathodes on the elevated and drained solid cathode surface may be reduced to between only 1 to 3 centimeters compared to 4 to 8 centimeters in a conventional aluminum reduction cell where cathodic reduction takes place on the top surface of a pool of liquid aluminum metal. The anodes in the improved cell may be constructed of either carbon or of an electrically conductive ceramic that is sparingly soluble in the molten salts. Oxygen ions from dissolved alumina produce carbon dioxide on carbon anodes and oxygen gas on a ceramic anode.

Titanium carbide produced by aluminum compositions that fall within zone B of FIG. 4 is normally able to form only a very thin aluminum wetted coating on the cathode carbon substrate because carbon from that substrate is required to react with titanium dissolved in the molten aluminum. Titanium carbide, grows only very slowly, even if relatively large concentrations of titanium is dissolved in the aluminum because the titanium carbide coating itself prevents direct contact between titanium dissolved in the molten aluminum and the carbon of the cathode substrate and because the rates of diffusion of both titanium and carbon atoms through the titanium carbide coating are very slow. Opposed to this slow growth rate. Titanium carbide dissolves relatively quickly and to a greater concentration than does titanium diboride in molten aluminum to saturate all the electrowon aluminum with respect to titanium carbide. Because titanium carbide grows on the cathode surface by reacting with carbon from the carbon cathode substrate, maintenance of a titanium carbide surface on the cathode typically results in a loss of 1 to 3 centimeters of carbon from the cathode carbon substrate over a five year cell life. Compared to titanium diboride, titanium carbide has a relatively high solubility in aluminum at 970° C.

Bullough (U.S. Pat. No. 3,471,380) proposed adding sufficient bauxite, containing titanium oxides to the cryolite bath of a conventional metal pool aluminum reduction cell to produce aluminum with a minimum titanium concentration in excess of 20,000 parts per million. This exceeds the solubility limit for dissolved titanium in aluminum at 970° C. Bullough's procedure was advocated as a start up treatment of a carbon cathode substrate in a conventional cell with a metal pool or a reconditioning treatment for old cells. Titanium was electroreduced along with aluminum. The cell operating voltage for a fixed anode to cathode distance decreased by 0.5 volts. The dissolved titanium allegedly reacted with the cathode carbon to produce a titanium carbide coating on the carbon lined cathode, although no physical evidence was offered. This prior art procedure specified the operation of the cell with aluminum deposited into a conventional metal pool cathode aluminum reduction cell with titanium concentrations falling far within zone B of FIG. 4. The practice of cell operation to produce aluminum with such large concentrations of dissolved titanium is undesirable. The aluminum produced by the cell titanium is contaminated far beyond the limits specified for most commercial alloys. A limit of only 50 parts per million of combined vanadium and titanium which degrades aluminum is permitted in many commercial alloys. Larger amounts of vanadium and titanium increases electrical conductivity, may interfere with casting properties and can create excessive amount of nonmetallic inclusions in the metal. The titanium concentration in aluminum can however be reduced by a relatively expensive treatment that may be practiced by adding elemental boron to the molten aluminum while it is held furnaces where it is usually placed after being tapped from the cells.

A thin titanium carbide layer produced by the periodic treatment advocated by Bullough can be quickly lost from the surface of a drained cathode carbon substrate surface and the carbon substrate rapidly damaged. The rate of damage to the uncoated cathode surface can then be as great as experienced in conventional aluminum electrowinning cells, employing a pool of aluminum metal as a cathode. These cathode carbon substrates may lose in excess of 1 to 10 centimeters per year of carbon. Loss of cathode coating can be rapidly detected by a significant loss of current efficiency of the aluminum smelting process. The drained cathode aluminum reduction cell overheats and become inoperable.

Localized loss of carbon from the cathode substrate of the drained cathode cell can cause harmful geometric changes to the drained cathode surface that is also reflected in roughening of the bottom surface of the anode. The roughening of both the anode and cathode surfaces interferes with draining aluminum metal from the cathode surface and the flow of carbon dioxide and electrolyte in the vertical gap between the cathodes and anodes.

The inventive cathode coating procedures allows departures from the arts described in prior art patents where the aluminum reduction cells are constructed with titanium diboride structures or coatings to produce aluminum wetted surfaces. Drained cathode cells using the present inventive coating procedure are constructed with the elevated cathode block substrates cut to desired slope for cell operation but unlike prior art patents do not require the installation of a cathode coating at the time of construction. The cell using the present inventive cathode coating procedures may be heated to operating temperature by any means that prevents significant burning of the carbon cathode substrate. Both gas burner and electrical heating may be used. Uniform heating of the cell may also be rapidly attained by pouring molten cryolite electrolyte and aluminum metal into the cold cell.

Electrolysis in cells using the inventive coating procedures are best started on full line current as soon as the molten cryolite is placed in the cell. In order to quickly achieve an aluminum wetted cathode surface and to prevent the carbon of the cathode substrate from being attacked by the electrowon molten aluminum metal, it is desirable, during at least the first couple of days or so of cell operation to produce aluminum compositions that fall within zones B, D or F of FIG. 4. Titanium concentrations between about 200 and 2000 parts per million are produced in the electrowon aluminum by adding relatively small quantities of titanium oxides, carbides or salts and lesser quantities of boron oxides, carbides or salts to the cryolite electrolyte. During this period, the cell is generally operated to produce aluminum metal containing higher titanium concentrations than are required for subsequent operation. If it is desired to start a titanium diboride coating at this time, the boron concentration must be greater than 25 part per million in the electrowon aluminum to establish zone F compositions in order to establish a titanium diboride plating rate in excess of 0.01 centimeters per year. Dissolved titanium will react chemically with exposed carbon and aluminum carbide on the carbon cathode substrate to form a coating containing both titanium carbide and titanium diboride. Because of the titanium diboride and/or titanium carbide deposits, the electrochemically reduced aluminum metal will quickly wet the cathode surface without attacking the carbon substrate. The relatively high titanium concentrations in the electrodeposited aluminum protects the carbon cathode substrate from being attacked by the electroreduced aluminum metal. The formation of aluminum carbide deposits on the carbon cathode substrate is thereby prevented and titanium diboride and/or titanium carbide layers are strongly chemically bound directly onto the carbon substrate surface.

Whenever titanium carbide is mentioned in this patent it is understood that the carbides of Groups IV-B, V-B and VI-B of the periodic table of elements and mixtures thereof are meant as the equivalent of titanium carbide and mixtures thereof and may be substituted for titanium carbide.

If at any time during the operation of the cell, with aluminum chemistries falling in zones C and E, areas of the cathode coating are lost, as detected by rough area on the bottom surfaces of the anode or by losses in current efficiency, aluminum carbide can form. A chemical treatment to produce aluminum metal having compositions that fall within zones B, D or F of FIG. 4, may be repeated to reestablish a continuous aluminum wetted surface on which titanium diboride will adhere. This chemical treatment requires increasing the feed rate of titanium oxides, carbides or salts to the cryolite bath to raise the concentration of titanium in the electrowon aluminum above 200 parts per million. It is not necessary to alter the boron feed rate to remove aluminum carbide deposits from the carbon surface and reestablish a continuous aluminum wetted coating.

After the first few days after cell start up, an aluminum wetted coating is well established on the cathode carbon substrate. The cell can then be operated with aluminum chemistries containing either a minimum titanium concentration to maintain a titanium carbide coating or with sufficient titanium and boron to form a titanium diboride coating on the cathode surface. The composition of the aluminum deposited on the cathode is modified by interrupting or reducing the rate of addition of titanium oxides, carbides or salts. This procedure establishes the chemical composition of the electrowon aluminum that may be maintained throughout the several year life of the cell. To produce a continuous and relatively thick titanium diboride coating on the cathode surface, the titanium and boron concentrations in the electrodeposited aluminum are set to compositions that fall above the dashed line in zones E or F of FIG. 4. Titanium and boron will be codeposited into the laminar film of aluminum on the solid cathode substrate to form a coating of titanium diboride on the solid cathode surface by the process of supersaturation plating at rates exceeding 0.01 centimeters per year while the aluminum tapped from the cell may have acceptable titanium concentrations. This supersaturation plating may continue throughout most of the life of the cell. Variations in the concentrations of electrowon boron and titanium in the laminar aluminum film on the cathode from time to time are not usually harmful. Occasional aluminum metal composition excursions to lower boron compositions where the composition of the aluminum falls within zones C or D, causes little harm. The average net rate of growth of the titanium diboride coating is reduced below 0.01 centimeters per year. Because the normal average rate of dissolution of the titanium diboride without the addition of titanium and boron oxides, carbides or salts added to the cell is about 0.04 centimeters per year there may be some areas of the cathode surface where there is a small net loss of titanium diboride coating. Aluminum metal composition excursions to lower boron compositions where the composition of the aluminum falls within zones A or B causes thinning and eventual loss of the titanium diboride coating.

The coating deposited by supersaturation plating may be either relatively pure titanium diboride or a mixture of titanium diboride and titanium carbide. Both titanium carbide and titanium diboride and mixtures of these materials are wetted by molten aluminum metal and are both suitable cathode coatings. When aluminum deposited on the cathode has a composition that falls within zone E of FIG. 4, there is supersaturation of titanium diboride but less than saturation of titanium carbide. Titanium carbide in the cathode coating may be transformed to titanium diboride but aluminum carbide deposits may also form. The addition of boron oxides, carbides or salts as well as titanium oxides or salts to the cryolite will produce an aluminum wetted cathode coating while generally protecting the cathode carbon from attack from aluminum metal. The ratio of boron to titanium added to the cell may be controlled to produce aluminum of greater purity than required for electrical conductors while reducing wear of the cathode substrate.

SPECIFIED EXAMPLES

Example 1

Titanium and boron oxides or salts are added to the cryolite electrolyte of a drained cathode aluminum reduction cell such as shown in U.S. Pat. No. 4,093,524 to electrowon aluminum with a composition of 180 parts per million titanium and 100 parts per million boron. This composition falls above the dashed line within zone E of FIG. 4. The aluminum metal is supersaturated with respect to titanium diboride but not with respect to titanium carbide. Relatively pure titanium diboride deposits on the solid cathode surface at the rate of about 0.08 centimeters per year. Most of the remainder of the titanium and boron deposits in the metal holding wells of the aluminum reduction cell to an equilibrium defined by the solubility product of titanium diboride so that the metal tapped from the cell has a titanium concentration of only about 20 parts per million.

Example 2

Titanium and boron oxides or salts are added to the cryolite of a drained cathode aluminum reduction cell such as shown in U.S. Pat. No. 4,093,524 to produce aluminum with a composition of 520 parts per million titanium and 235 parts per million boron. This composition falls within zone F of FIG. 4 and is also above the dashed line. The aluminum metal is supersaturated with respect to both titanium diboride and titanium carbide. Titanium diboride deposits on the solid cathode surface at the rate of about 0.24 centimeters per year. Because the carbon of the cathode substrate is generally covered by a dense layer of titanium diboride, little titanium carbide is formed in the deposit. When any areas of the carbon substrate surface become exposed due to mechanical damage or localized impingement of carbon dioxide bubbles dissolved titanium will react with any exposed carbon and aluminum carbide to deposit an aluminum wetted and protective surface coating of titanium carbide. Most of the titanium and boron that does not form coatings on the cathode surface forms deposits in the metal holding well of the aluminum reduction cell so that the metal tapped from the cell contains only about 40 parts per million titanium and 18 parts per million boron. The rate of build up of solid deposits in the metal wells is about one centimeter per year. This is nearly the maximum rate of build up of deposits that can be sustained in the metal well without excessively decreasing the volume available for the storage of aluminum metal between cell taps. If the volume in the metal wells are excessively diminished, the cell has to be tapped too frequently for economical plant operation.

Example 3

Titanium and boron oxides or salts are added to the cryolite electrolyte of a drained cathode aluminum reduction cell such as shown in U.S. Pat. No. 4,093,524 to electrowon aluminum with a composition of 180 parts per million titanium and 100 parts per million boron. This composition falls above the dashed line within zone E of FIG. 4. The aluminum metal is supersaturated with respect to titanium diboride but not with respect to titanium carbide. Relatively pure titanium diboride deposits on the solid cathode surface at the rate of about 0.08 centimeters per year. Most of the remainder of the titanium and boron deposits in the metal holding wells of the aluminum reduction cell to an equilibrium defined by the solubility product of titanium diboride so that the metal tapped from the cell has a titanium concentration of only about 20 parts per million.

Titanium dioxide and boric acid are mixed with the coke used to make the anode. 0.81 kilograms of titanium dioxide and 1.55 kilograms of ortho boric acid per 1000 kilograms of baked anode are mixed with the coal tar pitch and pressed into green anodes. The anodes are calcined, rodded and placed into the cell The titanium and boron are continuously fed to the cryolite bath as the anode is burned away.

Example 4

Titanium dioxide and boric acid are added to the cryolite of a drained cathode aluminum reduction cell such as shown in U.S. Pat. No. 4,093,524 to produce aluminum with a composition of 520 parts per million titanium and 235 parts per million boron. This composition falls within zone F of FIG. 4 and is also above the dashed line. The aluminum metal is supersaturated with respect to both titanium diboride and titanium carbide. Titanium diboride deposits on the solid cathode surface at the rate of about 0.24 centimeters per year. Because the carbon of the cathode substrate is generally covered by a dense layer of titanium diboride, little titanium carbide is formed in the deposit. Again, titanium dioxide and boric acid is mixed with the coke used to make the anode. 2.33 kilograms of titanium dioxide and 6.30 kilograms of ortho boric acid are mixed with each 1000 kilograms of petroleum coke and anode butts used to manufacture the anode.

When any areas of the carbon substrate surface become exposed due to mechanical damage or localized impingement of carbon dioxide bubbles, dissolved titanium will react with any exposed carbon and aluminum carbide to deposit an aluminum wetted and protective surface coating of titanium carbide. Most of the titanium and boron that does not form coatings on the cathode surface forms deposits in the metal holding well of the aluminum reduction cell so that the metal tapped from the cell contains only about 40 parts per million titanium and 18 parts per million boron. The rate of build up of solid deposits in the metal wells is about one centimeter per year. This is nearly the maximum rate of build up of deposits that can be sustained in the metal well without excessively decreasing the volume available for the storage of aluminum metal between cell taps. When the volume in the metal wells is excessively diminished, the cell has to be tapped too frequently for economical plant operation.

Example 5

Titanium and boron oxides are added to the cryolite electrolyte of a drained cathode aluminum reduction cell such as shown in U.S. Pat. No. 4,093,524 to electrowon aluminum with a composition of 300 parts per million titanium and 10 parts per million boron. This composition falls within zone D of FIG. 4 and is below the dashed line. Titanium diboride deposits in patches on the carbon cathode substrate at a rate of about 0.003 centimeters per year. Many areas of the cathode surface are not continuously covered by titanium diboride but are coated by a thin film of titanium carbide. These areas are dissolved away at rates up to about 1 centimeter per year but are continuously wetted by molten aluminum.

Example 6

Titanium and boron oxides are added to the cryolite electrolyte of a drained cathode aluminum reduction cell to produce aluminum with a composition of 300 parts per million titanium and 3 parts per million boron. This composition falls within zone B of FIG. 4 and is below the dashed line. The cathode surface is not covered by titanium diboride but is coated by a thin film of titanium carbide. It is dissolved away at rates up to 1 centimeter per year but is continuously wetted by molten aluminum.

When very large amounts of titanium and boron oxides, carbides or salts are added to the cryolite bath, very large supersaturations of titanium and boron are codeposited into the aluminum. This results not only in depositing too much titanium and boron in the metal wells but may also result in homogeneous nucleation of titanium diboride particles within the laminar aluminum layer. These particles may cause roughening of the cathode surface. At very high supersaturations, tree-like titanium diboride crystals may grow that protrude out of the laminar film of aluminum. Such deposits can interfere with the smooth flow of cryolite electrolyte over the cathode surface.

At 970° C. the solubility limit of titanium carbide is only 0.02 weight percent. The solubility of titanium diboride at its stoichiometric ratio of two boron atoms for each titanium atom is only a total of 58 parts per million. Aluminum metal, tapped from production cells having titanium diboride cathode coatings, installed at the time of cell construction according to prior art patents, produce aluminum metal with titanium and boron compositions that fall on or just below the solubility product line between zones A and C of FIG. 4. Aluminum metal tapped from these cells is usually found to contain relatively more titanium and relatively less boron than the stoichiometric ratio. It is known that the rate of dissolution of titanium diboride from these structures may be retarded by adding solubility suppressors in the form of from 10 to 30 parts per million boron and/or from 10 to 50 parts per million titanium to the aluminum in the cell (Ransley U.S. Pat. No. 3,028,324). This titanium and boron added to the pool of aluminum metal in the form of metallic boron or borides and metallic titanium provides most of the titanium and boron required to satisfy the titanium diboride solubility product so that relatively less of the relatively expensive titanium diboride structural elements is dissolved by the electrowon molten aluminum.

Alumina ores used to feed aluminum reduction cells may also contain up to 80 parts per million of titanium oxide as an impurity. Over one half of the titanium from the titanium oxides or salts fed to the cell with aluminum ore is normally lost to gases emitted by the cell, the aluminum produced from this alumina ore would normally contain about 60 parts per million titanium. The ore can provide enough titanium to satisfy the solubility product of titanium diboride if enough boron oxides, carbides or salts are also added to the cryolite to provide about 15 parts per million of boron to the electrowon aluminum metal. In conventional aluminum cells employing a metal pool cathode, boron oxides have been added to the cryolite for the purpose of reducing the concentrations of heavy metals (Karnauklov et al, Soviet Non-Ferrous Metals Research Translation Vol. 6, No. 1, pp 16–18 1978). Enough boron oxide may be added to the cryolite electrolyte so that top cathodic surface of the aluminum pool exceeds the solubility product of titanium diboride and has a composition that falls within zone C of FIG. 4, but because titanium diboride grows on the surfaces of vast numbers of suspended tramp nuclei in the molten aluminum pool, the average composition of the several tons of molten aluminum metal in the cathode pool never exceeds the solubility product of titanium diboride by a significant amount.

Enough boron can be added to the naturally occurring titanium impurity in the alumina fed to the cryolite by following the boron additions advocated by Karnauklov to produce aluminum metal with compositions that may fall within zone C of FIG. 4. Titanium impurities, normally present in commercial grades of alumina ore can supply only enough titanium to contribute to a slight supersaturation of the laminar aluminum film on the surface of a drained cathode surface to deposit titanium diboride at a rate considerably less than 0.01 centimeters per year. This rate of deposition is too slow to produce uniform aluminum wetted and protective surfaces on the carbon of the cathode substrate. The carbon cathode substrate would not be protected from the uneven dissolution of the titanium diboride caused by carbon dioxide bubble scouring, from mechanical damage, and electrical shorting from anodes.

Sane et al in U.S. Pat. No. 4,560,448 fed titanium diboride mixed with the alumina ore to produce dissolved titanium and boron concentrations near saturation in the molten aluminum pool. This titanium diboride acts as a solubility suppressor for titanium diboride coatings on ceramic oxide packing, submersed in aluminum pools in aluminum reduction cells. This procedure was originally disclosed by Ransley in U.S. Pat. No. 3,028,324.

One embodiment of U.S. Pat. No. 4,560,448 by Sane et al is to form titanium diboride coatings on the surfaces of ceramic oxide packing bed elements. The ceramic elements are first coated with a layer of titanium and boron oxides that are subsequently converted to titanium diboride by the process of aluminothermic reduction, achieved by submerging the ceramic elements in molten aluminum metal. This aluminum metal may be the deep cathode pool of an aluminum reduction cell. The present invention differs from that of Sane et al in a number of important aspects. Sane periodically forms thin porous titanium diboride coatings on ceramic oxide, preferably aluminum oxide structures by aluminothermic reduction of titanium oxide and boron oxide coatings on the ceramic structures by submersion in a deep pool of molten aluminum metal. The present invention forms thick non porous coatings of titanium diboride on drained cathode carbon substrates by the process of supersaturation plating. This process is achieved by continuously dissolving titanium and boron oxides, carbides or salts into cryolite based electrolyte and electrowinning supersaturation concentrations of elemental titanium and boron into a thin laminar film of molten aluminum.

Molten aluminum metal having concentrations of titanium and boron that fall into zones E and F of FIG. 4 deposited onto the cathode surface of a drained cathode cell will produce coatings containing titanium diboride according to the present invention. These coating deposits may also contain titanium carbide without causing harm to the coating or to the aluminum metal.

Titanium ions may be added to the cryolite electrolyte in the form of oxides and fluorides. The preferred form of titanium containing chemical is titanium oxide. Unrefined titania ($TiO_2$) in the form of rutile or anatase may also be used as a source of titanium ions in the bath. Boron may be added in the form of oxides, fluorides, titanates and titanium boron glass-like materials. The preferred boron containing chemicals are metal boric acid ($HBO_2$), ortho boric acid ($H_3BO_3$), however various boron containing chemicals including boron oxide ($B_2O_3$) and sodium boron oxides such as sodium metaborate, sodium tetraborate may serve as well.

Boron oxides and titanium oxides, or salts may be fed continuously to the electrolyte by being premixed with the ore, may have separate addition feeders or can be hand fed. Boron and titanium oxides, carbides, salts or even titanium diboride may be mixed with the carbon and pitch used to make the carbon anodes. If at least one of the several individual anodes in the cell contains titanium and/or boron; titanium and boron are continuously released at a uniform rate to the cryolite bath as the anodes are burned off by the smelting process. It is not necessary that all of the anodes contain both titanium and boron. It is possible to feed titanium and boron at a continuous and uniform rate as long as one or more anodes contain titanium and one contains boron. A uniform and continuous supersaturation of titanium diboride in the electrowon aluminum may be achieved by any of the above feeding methods.

I claim:

1. A method of coating a raised cathode surface in a raised cathode type reduction cell during the production of aluminum, comprising the steps of:

feeding oxides and salts into molten cryolite electrolyte within said cell and creating concentrations of ions containing aluminum and oxygen, and ions containing a metallic element selected from the group consisting of titanium, zirconium, hafnium, chromium, vanadium, niobium, tantalum, molybdenum, tungsten, and mixtures thereof and ions containing boron in said molten cryolite electrolyte;

electrowinning from said molten cryolite electrolyte a molten aluminum metal film against said raised cathode surface, said film containing dissolved concentrations of said metallic element and boron, which together supersaturate said aluminum metal film with the boride or mixture of borides of said metallic elements;

passing said molten aluminum metal film across said raised surface of said cathode, said raised surface comprising a refractory material non wetted by molten aluminum metal; and, depositing on said raised surface a boride coating created from concentrations of said metallic element or mixtures of said metallic elements and boron that exceed the saturation concentration of said boride or mixture of said borides in said molten aluminum film.

2. The method of claim 1, wherein:
said metallic element comprises zirconium.

3. The method of claim 1, wherein:
said metallic element comprises hafnium.

4. The method of claim 1, wherein:
said metallic element comprises Titanium.

5. The method of claim 1, wherein:
said refractory material comprises carbon.

6. The method of claim 1, wherein:
said coating is comprised of titanium diboride.

7. The method of claim 1, wherein:
said coating is between 5 angstroms and 5 centimeters in thickness.

8. The method of claim 1, wherein:
said coating is deposited at the rate of about 0.01 to 2.0 centimeters thickness per year.

9. A method of maintaining an aluminum wetted coating on a drained cathode surface of an aluminum reduction cell while aluminum is being smelted from a solution of aluminum oxide dissolved in molten cryolite, comprising the steps of:

feeding oxides and salts into molten cryolite within said cell and creating concentrations of ions containing aluminum and oxygen, and ions containing a metallic element selected from the group consisting of titanium, zirconium, hafnium, chromium, vanadium, niobium, tantalum, molybdenum, tungsten, and mixtures thereof and ions containing boron in said molten cryolite electrolyte;

electrowinning from said molten cryolite electrolyte a molten aluminum metal film against said raised cathode surface, said film containing dissolved concentrations of said metallic element or mixtures thereof and boron, which together supersaturate said aluminum metal film with the boride or mixture of borides of said metallic elements;

passing said molten aluminum metal film across said raised surface of said cathode, said raised surface comprising a substrate of refractory material, non wetted by molten aluminum metal; and, depositing on said raised cathode surface a boride coating created from concentrations of said metallic element or mixtures of said metallic elements and boron that exceed the saturation concentration of said boride or mixture of said borides in said molten aluminum film.

10. The method of claim 9, wherein:
said raised cathode surface is comprised of carbon.

11. The method of claim 9, wherein:
said metallic element comprises titanium.

12. The method of claim 9, wherein:

said coating comprises titanium diboride.

13. The method of claim 9, wherein:

said coating is deposited at the rate of about 0.01 to 2.0 centimeters thickness per year.

14. A method of operating a raised cathode type aluminum reduction cell comprising the steps of:

heating said cell to operating temperature;

feeding oxides and salts into molten cryolite electrolyte within said cell and creating concentrations of ions containing aluminum and oxygen, and ions containing a metallic element, selected from the group consisting of titanium, zirconium, hafnium, chromium, vanadium, niobium, tantalum, molybdenum, tungsten, and mixtures thereof, and ions containing boron, in said molten cryolite electrolyte;

electrowinning from said molten cryolite electrolyte a molten aluminum metal film against said raised cathode surface, said film containing dissolved concentrations of said metallic element or mixtures thereof and boron, which together supersaturate said molten aluminum film with the boride or mixture of borides of said metallic elements;

passing said molten aluminum metal film across said raised cathode surface, said raised surface comprising a substrate of refractory material, non wetted by molten aluminum metal; and, depositing on said raised cathode surface a boride coating created from concentrations of said metallic element or mixtures of said metallic elements and boron that exceed the saturation concentration of said borides or mixture of said borides in said molten aluminum film.

15. The method of claim 14, wherein:

said cathode substrate is comprised of carbon.

16. The method of claim 14, wherein:

said metallic element is titanium.

17. The method of claim 14, wherein:

said coating is comprised of titanium diboride.

18. The method of claim 14, wherein:

said coating is deposited at the rate of about 0.01 to 2.0 centimeters thickness per year.

19. A method of operating a raised cathode type aluminum reduction cell comprising the steps of:

heating said cell to operating temperature;

feeding oxides and salts into molten cryolite electrolyte within said cell and creating concentrations of ions containing aluminum and oxygen, and ions containing a metallic element, selected from the group consisting of titanium, zirconium, hafnium, chromium, vanadium, niobium, tantalum, molybdenum, tungsten, and mixtures thereof, and ions containing boron, in said molten cryolite electrolyte;

placing an anode into said molten cryolite, said anode being comprised of carbon and 0.005 to 13% by weight titanium dioxide and 0.0015 to 5% by weight boron oxide;

conducting direct electrical current through said anode into said molten cryolite producing carbon dioxide on said anode and dissolving said titanium dioxide and said boron oxide in said motel cryolite electrolyte;

electrowinning from said molten cryolite electrolyte a molten aluminum metal film against said raised cathode surface, said film containing dissolved concentrations of said metallic element or mixtures thereof and boron, which together supersaturate said molten aluminum film with the boride or mixture of borides of said metallic elements;

passing said molten aluminum metal film across said raised cathode surface, said raised cathode comprising a substrate of refractory material, non wetted by molten aluminum metal; and, depositing on said raised cathode surface a boride coating created from concentrations of said metallic element or mixtures of said metallic elements and boron that exceed the saturation concentration of said boride or mixture of said borides in said molten aluminum film.

20. The method of claim 19, wherein:

said metallic element comprises zirconium.

21. The method of claim 19, wherein:

said metallic element comprises hafnium.

22. The method of claim 19, wherein:

said metallic element comprises titanium.

23. The method of claim 19, wherein:

said refractory material comprises carbon.

24. The method of claim 19, wherein:

said coating is comprised of titanium diboride.

25. The method of claim 19, wherein:

said coating is between 5 angstroms and 5 centimeters in thickness.

26. The method of claim 19, wherein:

said coating is deposited at the rate of about 0.01 to 2.0 centimeters thickness per year.

27. A method of establishing a thin adherent carbide coating on the carbon substrate of a raised cathode in a raised cathode type aluminum reduction cell during the production of aluminum, comprising the steps of:

feeding said cell with a solution of dissolved aluminum oxide, and dissolved ions containing a metallic element, selected from the group consisting of titanium, zirconium, hafnium, chromium, vanadium, niobium, tantalum, molybdenum, tungsten, and mixtures thereof in molten cryolite electrolyte;

electrowinning from said molten cryolite electrolyte a molten aluminum metal film against said raised cathode, said film containing dissolved concentrations of said metallic element or mixtures thereof to react with said carbon cathode substrate to form carbides of titanium, zirconium, hafnium, chromium, vanadium, niobium, tantalum, molybdenum, tungsten, and mixtures of the carbides thereof, thereby thinly coating said carbon substrate.

28. The method of claim 27, wherein:

said metallic element is titanium.

29. The method of claim 27, wherein:

said coating is comprised of titanium carbide.

30. A method of operating a raised cathode type aluminum reduction cell, including a raised carbon cathode surface, comprising the steps of:

heating said cell to operating temperature;

feeding said cell with a solution of dissolved aluminum oxide, and dissolved ions containing a metallic element, selected from the group consisting of titanium, zirconium, hafnium, chromium, vanadium, niobium, tantalum, molybdenum, tungsten, and mixtures thereof, and dissolved ions containing boron, in molten cryolite electrolyte;

electrowinning from said molten cryolite electrolyte a molten aluminum metal film against said raised carbon cathode surface, said film containing concentrations of said dissolved metallic element or mixtures thereof and boron, which together supersaturate said molten aluminum with the boride or mixture of borides of said metallic elements and react with said carbon cathode substrate to form carbides of titanium, zirconium, hafnium, chromium, vanadium, niobium, tantalum, molybdenum, tungsten, and mixtures thereof;

passing said molten aluminum metal film across said raised cathode surface; and, forming on said raised cathode surface a thin film of the carbides of said metallic element of mixtures of the carbides thereof and depositing on said raised cathode surface a boride coating created from concentrations of said metallic element or mixtures of said metallic elements and boron that exceed the saturation concentration of said boride or mixture of said borides in said molten aluminum film.

31. The method of claim 30, wherein:
said metallic element comprises zirconium.

32. The method of claim 30, wherein:
said metallic element comprises hafnium.

33. The method of claim 30, wherein:
said metallic element comprises titanium.

34. The method of claim 30, wherein:
said coating is comprised of titanium diboride.

35. The method of claim 30, wherein:
said coating is between 5 angstroms and 5 centimeters in thickness.

36. The method of claim 30, wherein:
said coating is deposited at the rate of about 0.01 to 2.0 centimeters thickness per year.

* * * * *